United States Patent [19]

McGhie et al.

[11] 4,011,968

[45] Mar. 15, 1977

[54] COLLAPSIBLE CONTAINERS

[75] Inventors: Russell Park McGhie, Somers, N.Y.; Joseph George Ferraro, Wyckoff, N.J.

[73] Assignee: Colgate-Palmolive Company, New York, N.Y.

[22] Filed: Apr. 25, 1975

[21] Appl. No.: 571,511

Related U.S. Application Data

[63] Continuation of Ser. No. 393,307, Aug. 31, 1973, abandoned, which is a continuation of Ser. No. 200,922, Nov. 22, 1971, abandoned.

[52] U.S. Cl. ..... 222/107

[51] Int. Cl.[2] ..... B65D 35/12

[58] Field of Search ..... 222/107, 215, 92, 106; 220/81

[56] References Cited

UNITED STATES PATENTS

| | | | |
|---|---|---|---|
| 2,082,323 | 6/1937 | Bussey | 222/107 UX |
| 3,227,319 | 1/1966 | Rosier | 222/94 |
| 3,565,293 | 2/1971 | Schultz | 222/107 |
| 3,599,837 | 8/1971 | Anderson | 222/107 |

FOREIGN PATENTS OR APPLICATIONS

| | | | |
|---|---|---|---|
| 347,400 | 4/1931 | United Kingdom | 222/107 |

*Primary Examiner*—Robert B. Reeves
*Assistant Examiner*—John P. Shannon
*Attorney, Agent, or Firm*—Strauch, Nolan, Neale, Nies & Kurz

[57] ABSTRACT

A collapsible container comprises a flexible walled tubular body having a heat sealed longitudinal seam, an integral preformed non-metallic thermoplastic head member having an annular skirt telescoped and heat sealed within an end of the tube body, and an external skirt on the head member surrounding the outer side of the tube body around the heat sealed region.

1 Claim, 8 Drawing Figures

COLLAPSIBLE CONTAINERS

This is a continuation of application Ser. No. 393,307 filed Aug. 31, 1973, now abandoned which in turn is a continuation of Ser. No. 200,922 now abandoned.

This invention relates to collapsible containers and particularly to collapsible containers constructed and arranged for optimum protection of the product stored therein against deterioration, dissemination or leakage, contamination and loss of flavor and other desirable characteristics.

In its preferred embodiment the invention will be described as applied to a collapsible tube of the type used for storing and dispensing creams, such as dental, shave and hair dressing creams, fluent pastes, medical jellies, food mixtures, and any similar flowable product material.

Collapsible tubes for storing and dispensing various materials have been known for some time. Since flexibility during useful life, resistance to product penetration and impermeability to oxygen and other gases are extremely important, tubes with thin sheet aluminum walls have been proposed and used. For many products it has been found desirable to coat or laminate the entire interior with a barrier material to protect the metal against corrosion or reaction with acid or alkaline components of the product. The patents to Marchak U.S. Pat. No. 3,172,571; Brandt et al U.S. Pat. No. 3,260,410 and Dobson U.S. Pat. No. 3,260,411 are believed examples of commercial practice today. In these patents polyethylene head members are molded directly onto laminated plastic-metal foil-plastic tube bodies. Langer U.S. Pat. No. 2,440,339 discloses the protection of metal edges of laminated body material along longitudinal side seams, and Rosier U.S. Pat. No. 3,227,319 discloses direct molding of a plastic head member onto a longitudinally seamed body of laminated metal-plastic sheet material. Voke U.S. Pat. No. 2,383,230 discloses an all plastic tube wherein the body is heat sealed to the head member, but this type of tube does not have the collapsible advantages of the foil wall tube.

The present invention improves over such prior practices in that a tubular body having a metal foil wall is provided with a longitudinal heat sealed seam and is attached by heat sealing around the annular skirt of a preformed thermoplastic head member, and this is a major object of the invention.

The invention further contemplates inserting into the preformed head member a frictionally fitted barrier element that is particularly adapted to limit oxygen absorption and product penetration over the inner surface area of the polyethylene head member. This function is accomplished in the container body by the metal foil layer, but there is no metal foil in the head member. This problem has been recognized, and a solution proposed by the provision of inserts within the tube head as disclosed in the above mentioned Dobson patent and in Schultz U.S. Pat. No. 3,565,293 but those inserts are required to be fused or specially interlocked with head members that are directly molded onto the container body.

It is an object of the present invention to provide a collapsible tube structure wherein a tube body embodying a metal foil layer is attached by heat sealing to a preformed thermoplastic head member containing a frictionally mounted gas and product barrier insert.

Further objects of the invention will appear in connection with the appended claims and the accompanying drawings.

BRIEF DESCRIPTION OF DRAWINGS

Referring to FIGS. 1–4, the tube 11 has a flexible walled collapsible body 12 sealingly attached to a one-piece preformed non-metallic plastic head member 13. In this embodiment the discharge opening 14 through the head member is closed by an internally threaded cap 15 to fit with external threads 16 on the reduced diameter discharge nozzle 17 of the head member, but any suitable mounting of the cap on the head member may be employed. The tube body is eventually conventionally closed permanently as by crimping and heat sealing along its lower end at 18 after the product has been introduced into the body at that end.

Figure 4:
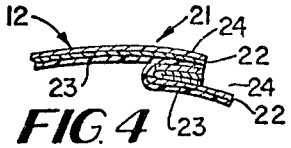
FIG. 4 is an enlarged section on line 4—4 of FIG. 1 exaggeratedly showing a preferred body side seam.

The tube body 12 is preferably formed from a single rectangular or trapezoidal blank 19 of laminated sheet material having its opposite side edges overlapped as shown in FIG. 4 to provide a longitudinal seam 21 extending the length of the body.

Figure 1:
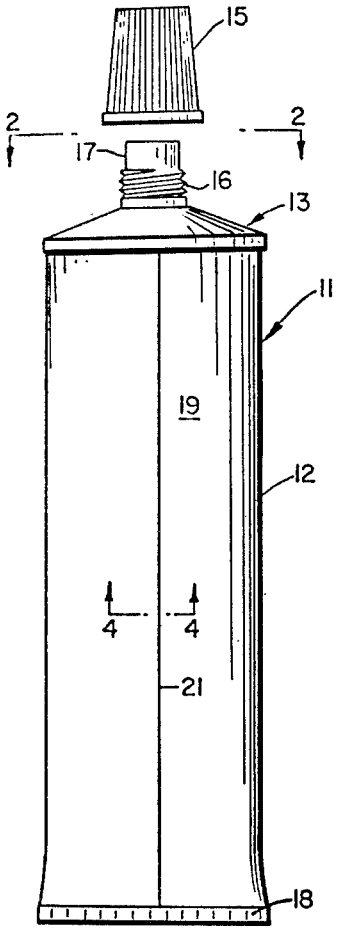
FIG. 1 is a side elevation showing a collapsible tube according to a preferred embodiment.
Figure 2:
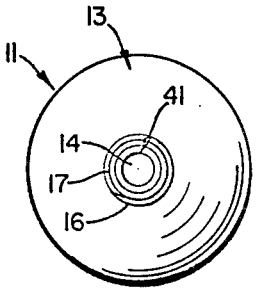
FIG. 2 is an end view of the top of the tube of FIG. 1.
Figure 3:
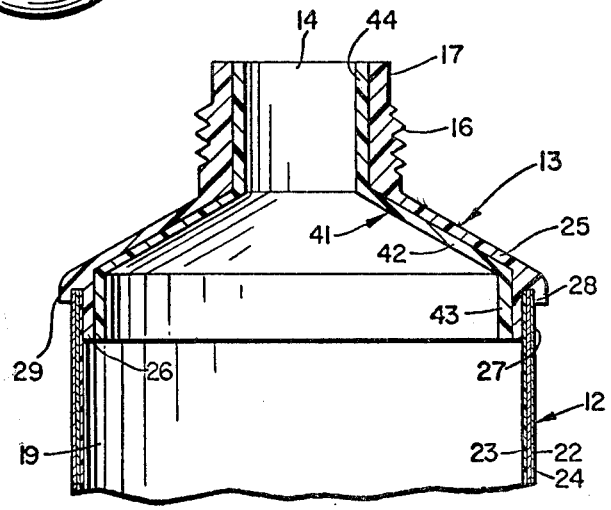
FIG. 3 is an enlarged fragmentary view showing attachment of the preformed head structure to the body of the tube of FIGS. 1 and 2.

As shown in FIGS. 3 and 4, blank 19 consists essentially of three laminations. A sheet 22 of metal foil, such as aluminum foil, has bonded upon its inner surface a layer or sheet 23 of synthetic thermoplastic material selected to be as inert as possible with respect to the contained product that contacts it. A bonded layer or sheet 24 covers the outer surface of the metal foil. This outer layer 24 may be applied by printing or spraying or may comprise a thermally bonded sheet of suitable thermoplastic material. The bonding between these layers resists the repeated flexing encountered during life of the tube, as that the layers do not separate or disintegrate during that period. Such bonding is known as indicated by the above-identified patent to Marchak for example.

As illustrated in FIG. 4, seam 21 is formed by folding back a narrow section all along one side edge of the blank so that a narrow band of the inner thermoplastic layer 23 faces externally and is overlapped by the end edge region of the other side of the blank, thereby bringing the blank side edges into full surface contact along narrow thermoplastic band surfaces extending the entire length of the blank. Upon application of heat and pressure the engaged thermoplastic regions along the seam are fused together permanently to form the body tube.

In the seam thus formed only the material of thermoplastic layer 23 is presented at the interior of the formed tube body, and the opposite metal edges of foil 22 are not exposed to the tube contents. Since the layers 22–24 are very thin, the foil layer for example being only about a few thousandths of an inch in thickness, such as ½ to 3 mils and the other layers are of related thicknesses, the application of pressure usually flattens the seam to practically flush condition and presents an acceptable aesthetic appearance. FIG. 4 shows the parts exaggeratedly for clarity of disclosure. For a more flush condition, outermost layers 22–24 may project slightly beyond the end edge regions of the overlapped layers. Thus, upon the application of pressure the seam region will present a more uniform appearance.

The integral thermoplastic head member 13 comprises an annular generally conical intermediate section 25 terminating at its inner end in an integral annular skirt 26 and at its outer end in integral discharge nozzle 17. Skirt 26 has a smooth cylindrical external surface 27 which is of such size as to have a snug telescopic fit within the end of tube body 12. The adjacent end of body 12 is disposed in end abutment with a flat annular shoulder surface 28 surrounding the root of skirt 26. The thermoplastic layer 23 of body 12 has a narrow band thereof around its upper end surrounding skirt 26, and the body and head member are heat sealed together all around the skirt by the application of heat and pressure which bonds that band to skirt 26.

Preferably the thermoplastic material of layer 23 is the same as that of the integral head member 13 so that a permanently fused continuous annular attaching and sealing band is provided around this juncture.

An annular integral skirt 29 on the head member surrounds the body upper end entirely around the heat sealed juncture as shown in FIG. 3 to provide a finished channel-like head formation completely enclosing the adjacent body end edges as well as providing a neat appearance and increasing the overall mechanical strength of the connection between the body tube and the head member. Skirt 29 is not relied upon to aid in sealing the juncture.

FIGS. 5–8 are illustrative of another embodiment that provides tubes for products that do not react, corrode or are otherwise undesirably affected by the aluminum or other metal foil layer. In terms of protection of the product against oxygen penetration, dissemination into the tube body material and reaction with the tube body material, the metal foil layer is usually optimum for many products. It is only for products like certain tooth pastes and the like that full internal barrier layers such as layer 23 of FIGS. 1–4 are required.

However there are problems in sealing longitudinal body seams of a metal tube and in attaching the body to a thermoplastic head member with a sealed juncture.

Figure 5:
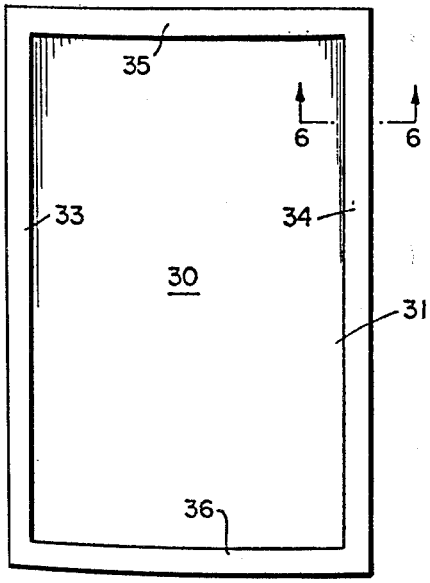
FIG. 5 shows a blank usable to form the tube body in a further embodiment.
Figure 6:
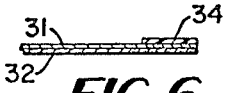
FIG. 6 is an enlarged exaggerated dimension section on line 6—6 of FIG. 5.

FIG. 5 shows a preferred blank 30 used in making a tube body that overcomes this problem. Blank 30 comprises a metal foil sheet 31 that has its outer side coated with the usual printing or like layer 32, corresponding to layer 24 of FIG. 3, but the entire metal inner surface is uncoated except for narrow longitudinal side edge bands 33 and 34 of uniform width and transverse top and bottom end bands 35 and 36, all of a thermoplastic material such as polyethylene surface bonded onto the metal and all disposed on the side of the blank that is to be the inside of the tube body. Bonds 33–36 preferably form a complete border around the blank periphery.

Optionally the blank inner surface bounded by bands 33 and 34 may be coated with a special purpose plastic or non-thermoplastic coating, depending on the product. For example coatings of epoxy or phenolics are contemplated.

Figure 7:
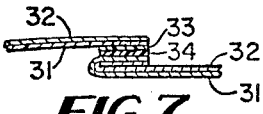
FIG. 7 is an enlarged section like FIG. 4 but showing the body side seam structure using the blank of FIG. 5.
Figure 8:
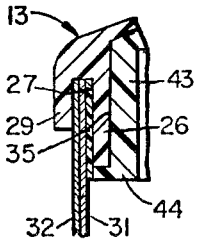
FIG. 8 is an enlarged fragmentary section showing the head to tube body juncture using the blank of FIG. 5.

In forming the tube body, the side edge of the blank containing band 34 is doubled back on itself as shown in FIG. 7 and the exposed outwardly facing band 34 is overlapped along its length by the band 33 coating the other side edge in form of the tube body. The bands 33 and 34 are fused together under heat and pressure to form a tight leak proof mechanically strong longitudinal seam along the body. The body end telescopes over the head member skirt 26 as shown in FIG. 8 with band 35 surrounding and in contact with skirt surface 27. Upon application of heat and pressure, band 35 and the head skirt 26 are sealed together as in the earlier embodiment.

In both disclosed embodiments the head member is preferably the same and is a premolded polyolefin unit, preferably polyethylene or polypropylene. A preformed barrier element 41, preferably molded of a urea formaldehyde or equivalent composition particularly resistant to oxygen absorption and product penetration, is mounted with a substantially friction tight fit within the head member 13. Element 41 is usually molded with its exterior shape and dimensions so related to the smooth interior surfaces of head member 11 that the element may be quickly pressed into place from the interior of the integral head member before attachment of the latter to the body tube. As shown in FIG. 3, element 41 comprises a generally conical intermediate section 42 effectively lining the corresponding part of head member 13, a skirt 43 coextensive with the inner wall of head skirt 26 and a central tubular section effectively lining nozzle 17. These barrier elements are usually formed of material that is stiffer and more rigid than polyethylene, so the inherent resiliency of the polyethylene may aid in retaining the element.

As shown in FIG. 8 barrier element 41 may have at the end of skirt 43 an external lip 44 that isolates the edge of skirt 26 from the product and also serves as a stop during insertion of element 41.

Instead of using regular rectangular blanks, in either embodiment it may be desirable to use substantially trapezoidal blanks with the wider parallel end serving to define the lower end of the tube body. This will form a tapered tube body in the above, permitting space saving stacking of empty tubes being shipped from the tube making machine to the filling machine.

We claim:

1. A collapsible container comprising a tubular body made from a single blank of flexible sheet material having its opposite side edges overlapped to provide a longitudinal seam, said blank comprising a sheet of metal foil extending over substantially the full area of the blank and having non-metallic thermoplastic material surface bonded at least along side edge areas of one surface of said foil which is to be the inner surface of the tube body in such locations as to provide a heat sealed narrow band of thermoplastic material along and within said longitudinal body seam upon overlap of the side edges of the blank to form a tube body and an integral one-piece preformed non-metallic solid head member of thermoplastic material having an annular skirt telescoped within an end of said tube body, and insert element of a material that is less subject to oxygen absorption and less permeable to the product in the tube body than the material of said head member tightly frictionally disposed within said head member for isolating coextensive surfaces of said head member with respect to the product in the container, said metal foil having a further area of thermoplastic material surface bonded thereon on said one surface at least in a narrow band at the tube body upper end surrounding said skirt, said areas of thermoplastic material being substantially continuous, and said tube body and head member being heat sealed together at said annular band in an annular region extending entirely around said skirt, an external skirt on said head member closely surrounding the outer side of said tube body around said heat sealed region, said skirts being spaced at their root ends by an annular shoulder against which the tube body is disposed in end abutment and said insert element having an external lip underlying the lower edge of said annular skirt.

* * * * *